United States Patent [19]

Levy

[11] 4,147,282

[45] Apr. 3, 1979

[54] VACUUM ACTUATED PRESSURIZED FLUID DISPENSER

[76] Inventor: Sidney Levy, 145 W. Cuthbert Blvd., Oaklyn, N.J. 08107

[21] Appl. No.: 803,478

[22] Filed: Jun. 6, 1977

[51] Int. Cl.[2] ..... B67D 5/54

[52] U.S. Cl. ..... 222/387; 222/389; 239/322

[58] Field of Search ..... 222/95, 386, 386.5, 222/387, 389, 212, 263; 239/322, 323; 128/214 F, DIG. 5, DIG. 12

[56] References Cited

U.S. PATENT DOCUMENTS

| | | | |
|---|---|---|---|
| 580,052 | 4/1897 | Lindemeyer | 222/95 |
| 1,854,458 | 4/1932 | Quincy et al. | 222/386.5 X |
| 2,098,408 | 11/1937 | Watson | 222/386 X |
| 3,327,906 | 6/1967 | Gömann | 222/389 |
| 3,407,974 | 10/1968 | Chmielowiec | 222/389 X |
| 3,468,308 | 9/1969 | Bierman | 222/212 X |
| 3,561,644 | 2/1971 | Works | 222/95 |
| 3,604,417 | 9/1971 | Stolzenberg | 222/389 X |
| 3,976,223 | 8/1976 | Jass et al. | 222/95 X |

FOREIGN PATENT DOCUMENTS

| | | | |
|---|---|---|---|
| 2356478 | 5/1974 | Fed. Rep. of Germany | 222/389 |

*Primary Examiner*—Robert J. Spar
*Assistant Examiner*—Fred A. Silverberg
*Attorney, Agent, or Firm*—Finnegan, Henderson, Farabow & Garrett

[57] ABSTRACT

A dispenser device which has the contents under pressure so that they can be dispensed by actuating a valve similar to an aerosol unit. The contents are maintained under pressure by using a movable piston element driven by external air pressure against the contents which are contained in an enclosure within an evacuated vessel. The dispenser can be filled and sealed at atmospheric pressure and normal temperature and activated by evacuating the unit.

20 Claims, 11 Drawing Figures

VACUUM ACTUATED PRESSURIZED FLUID DISPENSER

BACKGROUND OF THE INVENTION

This invention relates to an imroved pressurized dispenser unit which can be used to dispense the contents by operating a valve that maintains the pressure within the container similar to an aerosol container. Specifically the invention relates to a dispenser in which the contents are maintained under pressure by using atmospheric pressure acting against a piston unit which closes the end of a container that has been evacuated.

Aerosol containers are and have been widely used to package many products which are conveniently dispensed as a spray or as a foam which results when the pressurized contents are released by the action of the valve on the dispenser. There are many drawbacks to the present aerosol units. One of these is the fact that a low boiling liquid such as a fluorocarbon must be dissolved into the cans contents to supply the pressure required for the unit to operate. In addition to the cost of such propellant material, which usually comprises at least half of the contents of the can, there is curent concern with the effect of the propellants on the environment.

Another substantial drawback in the present type of aerosol unit is the fact that the compatability of the various ingredients with the propellant must be carefully evaluated. In some instances the composition of the contents are such that a special propellant must be used or, alternately, the formulation of the contents must be altered in order for the aerosol package to be made. This adds substantially to the packaging cost as well as to the cost of development for a specific aerosol package. The instant invention uses the contents material in concentrate form and there is no propellant which eliminates the compatability requirement.

Aerosol dispensers containing fluids use dip tubes to connect the valve to the lower portion of the contents in order to remove most of the contents from the dispenser. This is not required in this new type of dispenser since the contents are pressurized up to the valve and there is no vapor space over the contents. The fact that there is no vapor space also provides another substantial advantage in that, unlike the conventional aerosol units, this one will dispense the contents in any position including upside down.

Alternatives have been proposed to the aerosol unit in which pumping devices are attached to the dispenser. These units have substantial drawbacks compared to the aerosol units in that the delivery of the contents are cyclical instead of continuous. In addition, the pressure level that can be applied to the contents is limited and the use of the pump units is fatiguing to the operator. Other problems such as leakage from the pumps and clogging of the delivery systems are frequent.

The instant invention is capable of maintaining the contents under a constant predetermined pressure which can be made whatever is required to properly dispense the contents. This pressure is determined by the dimensions of the various parts of the dispenser and their interrelationship. In this respect the instant invention is capable of packaging many materials which could not be handled by the propellant containing aerosol units. The absence of the propellant also eliminates the variability of pressure due to the temperature changes of the surrounding environment which frequently causes poor performance of conventional aerosol units, particularly at low temperatures. The absence of the propellant introduces a degree of safety to the dispensr of the instant invention. In conventional aerosol units at high temperature the propellant can generate very high pressures which may lead to rupture of the container in an explosive manner which is a dangerous condition. The instant invention does not pose this hazard. If the contents of the dispenser do not generate a great deal of volatiles at elevated temperatures, there is no explosion hazard. The vacuum surrounding the contents adds a positive safety factor by excluding air from the contents in the event that the contents are flammable.

There are conveniences in the filling operation which represent cost savings in the use of the instant invention. The container can be filled with simple measuring and filling equipment since it can be done under normal room conditions. The activation of the dispenser can be done immediately subsequent to the filling or it can be delayed to a later time so that the contents can be stored unactivated. This would have the advantage of safe storage since there would be no pressure condition to be concerned with. The packages can be activated at the time of shipment which would reduce the number of potentially defective units due to leaking valves or leaking seals that usually develop as a result of long term storage under pressure.

Another advantage of the invention is that it can make use of the existing technology of valves to dispense the contents of the dispenser which have been developed for the standard aerosol container. Other features such as flexibility in shape are also basic to the invention.

SUMMARY OF THE INVENTION

It is accordingly an object of the present invention to overcome the problems of conventional aerosol dispensers.

It is another object of the present invention to provide an easly manufactured dispenser which provides the fluid contents under pressure so that the contents can be dispensed by the actuation of a valve.

It is a further object of this invention to provide a pressurized dispenser which does not use any propellant material.

It is a still further object of the invention to provide a pressurized dispenser in which the dispensing pressure can be set by the selection of the dimensions of the container to suit the application.

Yet another object of the present invention is to provide a pressurized dispenser which can use available valve units currently used in conjunction with present aerosol dispensers.

It is a further object of the present invention to provide a pressurized dispenser in which the compatibility problems of conventional aerosol units are eliminated.

Another object of the instant invention is to provide a pressurized container which can be operated in any position.

A further object of the invention is to provide a pressurized dispenser that is relatively much safter than present aerosol units.

An additional object of this invention is to provide a pressurized dispenser that can be filled under normal temperature and pressure conditions.

Yet another object of the present invention is to provide for a pressurized dispenser in which the filling operation and the pressurization operations and separate and where the pressurization can be done just prior to shipment of the product to minimize leakage problems.

It is still another object of this invention to provide a pressurized dispenser which is insensitive to the external temperature with respect to the pressure applied to the contents.

It is yet another object of this invention to provide a pressurized dispenser which can be manufactured at low cost from a wide range of materials by a number of manufacturing processes to provide containers that are capable of containing the widest variety of materials to be packaged.

Briefly the invention comprises a container which has a pistonlike movable element that presses against an inner container unit which is made so that it can collapse to eject its contents. The inner container is attached to a valve structure which controls the expulsion of the contents. The projected area of the inner container is substantially less than the projected area of the pistonlike moveable element. When the volume between the two containers is evacuated, the pistonlike element is subjected to a force equal to its projected area times atmospheric pressure which presses against the end of the collapsible inner container of smaller projected area to create a pressure in the collapsible inner container. This pressure is equal to the ratio of the projected area of the pistonlike element divided by the projected area of the inner container times the normal atmospheric pressure.

The container is filled by having the top open so that the inner collapsible container can be filled at ordinary pressure. The top is then sealed with a valve unit and the space between the inner and outer container evacuated. The dispenser is then operative.

BRIEF DESCRIPTION OF THE DRAWINGS

With the above mentioned and additional objects and advantages in view, as will hereinafter appear, this invention comprises the devices, combinations and arrangement of parts hereinafter described by way of example and illustrated in the accompanying drawings of a preferred embodiment in which.

In the various figures of the drawings like reference characters designate like parts.

DESCRIPTION OF THE PREFERRED EMBODIMENT

Figure 1:
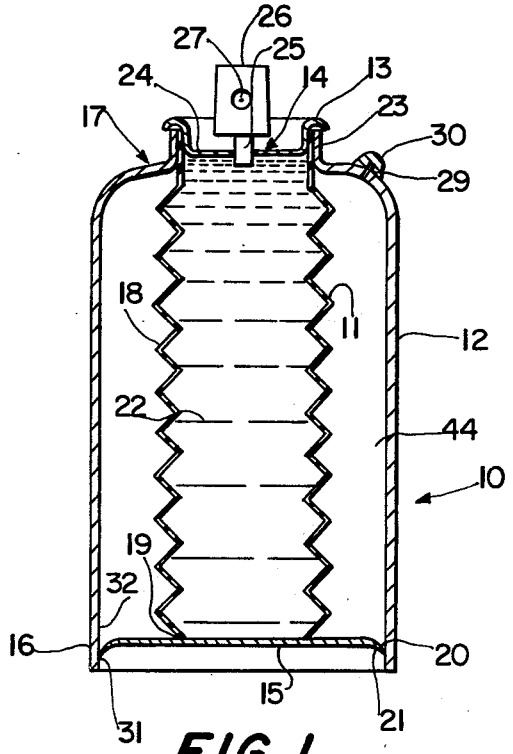
FIG. 1 is a view in section of the pressurized dispenser of the present invention showing it filled and ready to operate.
Figure 2:
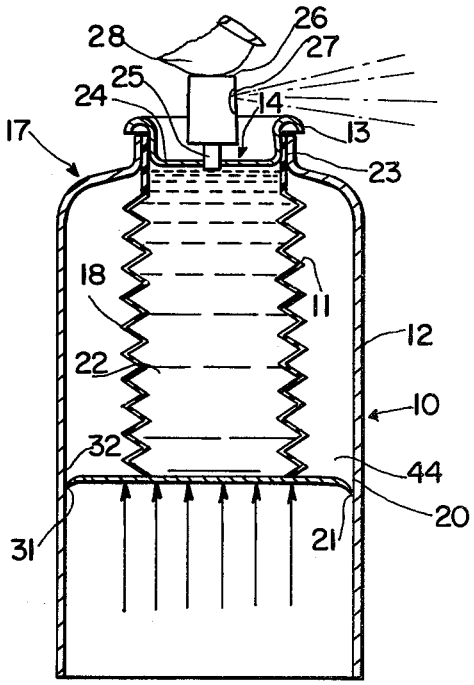
FIG. 2 is a view in section of the pressurized container of the present invention showing how the contents are expelled and showing the action of the expelling unit.

Referring now to FIGS. 1–11 there is shown the construction of a pressurized dispenser unit 10 which is broadly shown as a composite container containing an inner container unit 11 and an outer container unit 12 connected at one point 13 to a valve structure 14 and having a displaceable pistonlike element 15 closing the end 16 of the outer container 12 opposite to the valve containing end 17. The inner container 11 is of a collapsible construction which in the illustration is a bellows structure 18. The pistonlike member 15 presses against the lower end 19 of the inner container 11. The pistonlike member 15 is sealed against inner wall of the outer container 12 at point 20 by means of either a resilient sal 21 or by one of the other means hereinafter described.

The valve structure 14 is attached to the dual container structure by means such as crimping or force fitting as is usually employed in aerosol sealing, after the inner container 11 has been filled with the contents 22. The point at which the crimping is done is the junction between the inner container and the outer container at 23. The valve structure 14 comprises a cap section 24, a valve 25, and an actuating button 26 containing a nozzle 27.

When the valve button 26 is depressed as shown at 28 the contents of the dispenser are expelled under pressure from the pressurized dispenser. The space 44 between the inner container 11 and the outer container 12 is evacuated through the evacuaton opening 29 which is subsequently sealed by the cap 30.

As the valve 25 is actuated by the button 26 and the contents 22 are expelled through the nozzle 27, the pistonlike element 15 moves in response to the atmospheric pressure acting upon it to continue to drive the contents out under a constant pressure.

One of the necessary conditions for the successful operation of the invention is that there be a good seal between the pistonlike member 15 and the outer container wall. In the seal embodiment shown in FIGS. 1, 2, and 3 the seal is a sliding contact between the curved resilient portion 31 of the pistonlike member 15 and the inner wall of the outer container 12. To facilitate the integrity of this seal the use of a grease or wax material as is commonly employed in the art will improve the integrity of the seal. Alternately the seal may be changed to one of the constructions shown in FIGS. 4, 5 and 6 which will now be described in detail.

Figure 3:
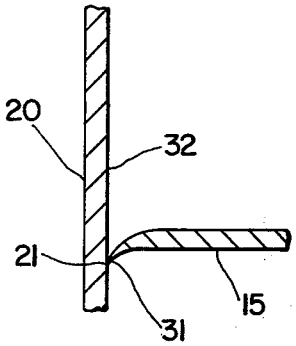
FIG. 3 is an enlarged view in section of the seal between the pistonlike member of the pressurized container and the outer wall of the container.
Figure 4:
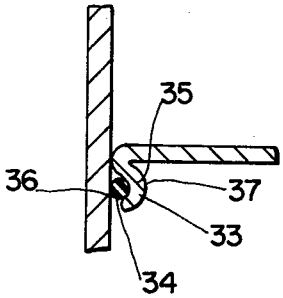
FIG. 4 is an enlarged view of an alternate construction of the seal between the pistonlike member and the outer container wall.

The construction shown in FIG. 4 would be preferred if the pistonlike member 15 is made of a rigid material while the construction shown in FIG. 3 would be preferred if the pistonlike member is made of a resilient material such as a plastic. In the embodiment shown in FIG. 4 the pistonlike member 15 is fitted with a reentrant section 37 into which is fitted a resilient seal element 34 such as an O-ring made from an elastomeric material to provide the seal at the points 35 and 36 wherein 35 is a static seal and 36 is a sliding seal.

Figure 5:
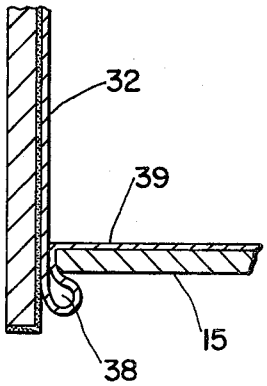
FIG. 5 is a view of an integral seal type of connection between the pistonlike member and the outer container wall which is another construction of the unit.

In FIG. 5 the seal is made between the outer container 12 and the pistonlike member 15 by means of a membrane 38 which rolls between the outer edge 39 of the pistonlike member 15 and the inner surface 32 of the outer container 12. This rolling diaphragm is known in the arts to provide a suitable seal for a pressure piston such as 15.

Figure 6:
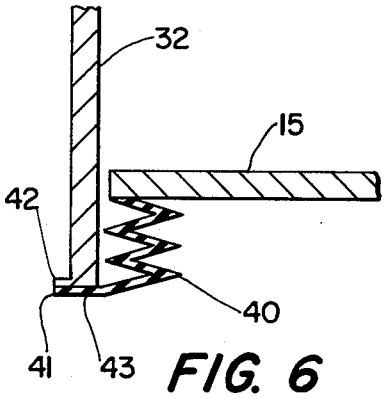
FIGS. 6 is an enlarged view of another type of seal between the pistonlike member and the outer container utilizing a bellows.

In FIG. 6 a different structure is used to provide the seal between the pistonlike member 15 and the inner wall 32 of the outer container 12. The pistonlike member 15 is attached to the outer container 12 by means of the bellows structure 40.

This bellows structure is sealed at point 41 by means of the flange 42 on the outer container and the flange 43 on the bellows section to the outer container 12 by an adhesive or welding process. The pistonlike member 15 can move under the action of the atmospheric pressure by expanding the bellows structure 40 and allowing the pistonlike member 15 to move inwardly into the outer container 12.

Several seal constructions are shown in order to cover the range of materials that may be packaged. Some of the seals may be appropriate for certain packaging applications.

Figure 7:
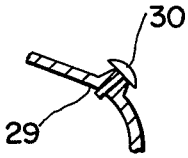
FIG. 7 is an enlarged view of the evacuation port in the outer container showing the details of the capping.

FIG. 7 shows the aperture 29 through which the air in the space 44 is evacuated and a cap element 30 which can be used to close the aperture 29. The aperture is shown on the wall of the outer container near the upper shoulder of the container but it can be located at any convenient point which may include a location on the pistonlike member 15. The aperture can be closed with the cap 30 or it can be crimped shut or heat sealed shut if a plastics material is used to make the outer container 12 or welded shut if it is metal.

Figure 8:
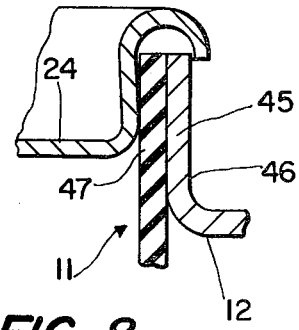
FIG. 8 is an enlarged view of the seal between the valve unit and the double container unit.

FIG. 8 shows an enlarged view of the neck section 23 of the dual container 10 in which the manner in which the surface 45 seals the inner and outer containers together from the pressure exerted by the cap section 24 of the valve structure 14. During the crimping or insertion process the walls 46 of the outer container 12 and 47 of the inner container 11 are pressed together at 45 to make a seal.

It should be pointed out that while the crimp seal type aerosol valve structure is shown in conjunction with the invention, the structure at this part of the pressurized container can be altered to utilize other constructions including swedge valve structures and screw type valve structures which have been and are used in the manufacture of aerosol type containers. In addition, the embodiment is shown with one particular type of aerosol valve which is in no way limiting, since all of the known and possible types of aerosol valve structures can be incorporated into the instant inventions by making suitable design changes which are obvious to one skilled in the art.

Figure 9:
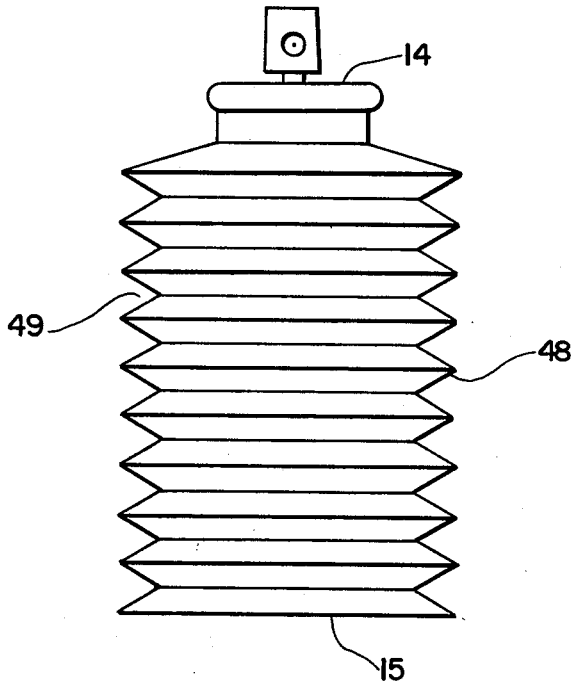
FIG. 9 is another embodiment of the invention in which the outer container is a collapsible bellows unit.

FIG. 9 illustrates another general construction of the instant invention in which the outer container is also a bellows structure. While not shown, the inner container is similar to that shown in the other preferred embodiment of FIGS. 1 and 2. The use of the bellows structure 48 obviates the need for a seal area between the pistonlike member 15 and the outer container 49. The pistonlike member 15 moves with the bellows 48 to collapse the outer container 49 and the resulting displacement expels the contents of the inner container 11 through the valve structure 14.

Figure 10:
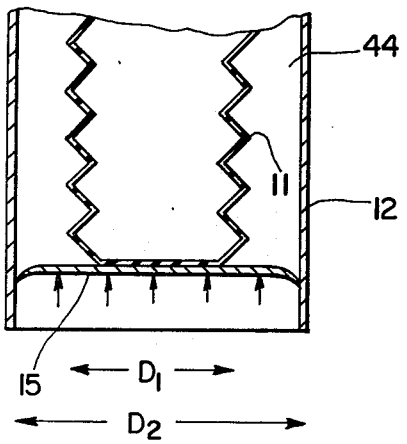
FIG. 10 is a diagram of the container of the instant invention which shows the relationship between the external pressure and the pressure on the contents of the dispenser.

FIG. 10 is a partial view of the preferred embodiment which is dimensioned to show the pressure relationships in the pressurized dispenser 10. $D_1$ and $D_2$ are dimensions which define the size of inner container 11 and the outer container 12 respectively. If the cross section of the containers are round this dimension would be the diameter. If the cross sections of the inner and outer container are similar figures such as squares, rectangles, ovals, etc., these values would be similar parts such as diagonals, semi diameters, etc. As a consequence, the squares of these dimensions would represent a factor which is proportional to the area of the resepctive elements. The general relationship for the pressure in the pressurized dispenser is:

$$\text{PRESSURE IN INNER CONTAINER 11} = \text{Atmospheric Pressure} \times [(A_2)/(A_1)]$$

where $A_1$ = Area of inner container
$A_2$ = Area of outer container

Substituting the corresponding area controlling dimensions $D_1, D_2$ $$\text{Pressure in inner container} = \text{Atmospheric pressure} \times [(D_2^2)/(D_1^2)]$$

As an example if the dimension of the outer container were 2" and the required inner container pressure is 30 pounds per square inch and assuming atmospheric pressure is 15 pounds per square inch $$30 = 15 \times (2)^2/(D_1)^2 \qquad D_1 = 1.414''$$

Similar calculations will establish the relationship between the dimensions of the outer container 12 and the inner container 11 that determine the projected area relationship and the internal pressure in the inner container 11. It should be noted that the cross section of both the inner and outer container is in no way limited except by the neck congruence.

Figure 11:
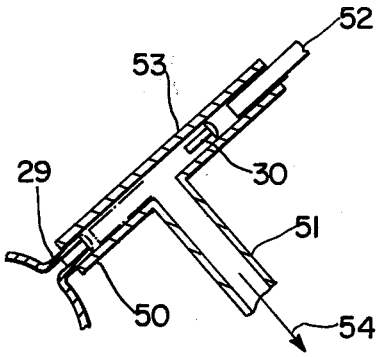
FIG. 11 is a diagram of one manner in which the outer container can be evacuated.

FIG. 11 is a pictorial representation of one means for inserting the cap 30 into the evacuation opening 19 after evacuating the container 11. A T shape pipe section is attached to the evacuation opening 29 by one leg 50. The right angle leg 51 is attached to a source of vacuum 54. The straight through leg 53 contains the cap 30 in resilient contact with the tube wall of the leg 53. After the pressurized dispenser 10 is evacuated the cap 30 is pressed into the evacuation opening 29 by means of a plunger 52 while the vacuum is still applied. The tube 50 is then removed from the evacuation opening 29. The figures do not show the cross section shape of the pressurized dispenser since it is immaterial what these shapes are to the function of the invention. The only requirement is that the inner container 11 be capable of axial collapse and that the projected area of the pistonlike member 15 excede the projected area of the inner container 11. For the reason of mechanical stability it is necessary that the pistonlike member move parallel to the axis of the inner container. To fulfil this requirement it is necessary that the axis of the inner container 11 and the outer container 12 be either coaxial or paraxial (axes parallel). All of the construction shown meet this requirement. The other essential requirement is that the pressurized dispenser unit be capable of having the space 44 between the inner container 11 and the outer container evacuated and be maintained in an evacuated state.

The pressurized dispenser of the instant invention can be made from a variety of materials and combinations of materials including metals and plastics. The outer container 11 may be made of steel, aluminum, plastics, or possibly even a specially treated cardboard. The inner container should be made of a material which is capable of being formed into the bellows structure or some other axially collapsible structure. The material of the inner container 11 should be sufficiently stiff that it will not expand against the pressure difference between the inner container and the outer container to the point where it deforms. Materials that would meet these requirements are metal, plastics, and resin reinforced fabrics among others.

It was previously stated that one manner to assist the sealing of the pistonlike member 15 was to use a wax or grease in the joint 31. Such a material might be Apeizon Wax or a silicone grease of the type used to seal vacuum systems and which are well known in the art.

FIG. 11 represents one preferred method of evacuating the space 44 but a large number of others are possible including immersing the entire dispenser in a vacuum chamber and engaging the seal cap 30 while the unit is in the vacuum chamber. In lieu of the cap 30 other cap configurations can be employed without departing from the spirit of the invention. It may be a matter of convenience in the application of the invention not to use a cap but instead to seal the evacuation opening 29 by a pressure seal or by welding the tubulation shut or by heat sealing the tubulation shut as might be done in the case of a plastics outer container.

While in no way restricting the scope of the instant invention some typical manufacturing methods will be described for the elements of the pressurized fluid dispenser. The inner container could be made by blow molding a plastic to form the bellows container. Among the materials that could be employed in this process would be a thermoplastic polyester such as polyethylene glycol terephthallate, a polyolefin such as polypropylene, or an Acrylonitrile polymer. The process which would give the best neck dimensional control would be injection blow molding. Usng the refinement of stretch blowing would yield a high strength container with relatively thin walls. The range of wall thicknesses that probably would result and be useful would range from 0.002 to 0.015 inches although the wall thickness could be more or less in specific circumstances with specific plastics.

The inner container, should it be made of metal, can be made by using hydroforming techniques on a drawn tube to generate the bellows structure. Typical wall thicknesses would range from 0.002 to 0.015 inches depending on the material and the application. Aluminum would be a typical material for this application as would a large number of metal alloys widely used in packaging applications. The outer container could be made by injection molding of a plastics material such as polypropylene, a thermoplastic polyester, an Acrylonitrile Butadiene Styrene polymer, and other rigid plastics. These may also be filled materials containing reinforcing filler such as fiberglass. The outer container can also be made by the injection stretch blow molding process so that the pistonlike section is an integral part of the molding. This can be removed and reattached to the combination to render it functional. The seal constructions in FIGS. 3, 4, and 5 would particularly suited to this approach. The pistonlike member can also be made by injection molding of a separate part from a suitable material. The wall thicknesses that would be suitable would range from 0.005 to 0.035 inches or greater depending on the specific material and process used. The pistonlike member should be made sufficiently thick that it will not bend as a result of the forces acting on it. In a plastic, depending on the material and process used, the thickness would be in the range of 0.005 to 0.080 inches. Special stiffening ribs can be added to the design of the pistonlike member to improve the resistance to bending.

The outer container can be made of metal by such processes as deep drawing, impact extrusion, and spinning depending on which metal is employed. The probable range of wall thickness is 0.005 to 0.010 inches for steel and 0.005 to 0.015 inches for aluminum which are two widely used metals in packaging applications. The pistonlike member in FIG. 4 could be made from metal by either stamping or spinning and the probable range of thickness would be 0.005 to 0.015 inches thick.

The valve structures shown in conjunction with the instant invention are those commonly employed with aerosol dispensers of the propellant type. These will function with the instant invention in essentially the same manner in which they do with conventional aerosol dispensers. The requirement for the dip tube normally employed is eliminated, however, since the fluid in the pressurized dispenser is at the valve at all times. Since a large variety of valves for different products have been evolved, the enunmeration of the types and structures are deemed unnecessary because they would be known to one skilled in the art.

Numerous alterations and modifications of the structure herein disclosed as a preferred embodiment will suggest themselves to those skilled in the art. However, it is to be understood that the present disclosure relates to a preferred embodiment of the invention which is for the purposes of illustration only and is not to be construed as a limitation of the invention.

What is claimed is:

1. A pressurized fluid dispenser comprising an inner axially collapsible container gravity fillable with said fluid to be dispensed, an outer surrounding container defining an annular space between the inner and outer containers capable of being evacuated, means on said dispenser to permit evacuation of the space between the inner and outer containers, piston means for imposing pressure on said inner container to expel its contents, said piston means acting within said outer container and sealably attached therewith and being movable coaxially or paraxially of said inner container, said piston means having one surface exposed to the atmosphere and an opposite surface exposed to said evacuatable space and against said inner container valve means for controlling the egress of the contents of said inner axially collapsible container, said inner axially collapsible container having a projected area perpendicular to its axis sufficiently less than the projected area of said piston means perpendicular to the axis of said inner axially collapsible container that the action of the atmosphere on said piston means when said annular space is evacuated presses said piston means against said inner axially collapsible container to controllably expel the contents of said axially collapsible inner container through said valve means without the necessity of pressurized filling of said inner, axially collapsible container.

2. A pressurized fluid dispenser as described in claim 1 wherein the axially collapsible inner container is a bellows type container wherein the bellows elements permit the collapse of said inner axially collapsible container by the folding of said bellows elements.

3. A pressurized fluid dispenser unit as in claim 1 wherein the piston means member is a form fitting element with a sealable edge that fits closely within the interior of said outer surrounding container, said sealable edge comprising a thinned resilient portion of the material of said piston means.

4. A pressurized fluid dispenser as in claim 1 wherein the piston means member comprise a substantially flat, form fitting, element that closely conforms to the inside of said outer surrounding container, said substantially flat form fitting element having a reentrant section on the edge thereof adapted to receive an O-ring sealing ring, said reentrent section containing therein an O-ring sealing ring whereby said pistonlike member is effectively sealed to the inside of said outer surrounding container to confine said space which is evacuated and isolate if from the surroundings to contain the vacuum therein.

5. A pressurized fluid dispenser as in claim 1 wherein the piston means member is a form fitting element which substantially is a match to the interior of said outer surrounding container, and means comprising a membrane which is attached to said pistonlike member and to said inner wall of said outer surrounding container to seal said piston means member to said outer surrounding container, said membrane means capable of rollably moving when said pistonlike element is moved by the action of the atmosphere on said pistonlike member when the space between said outer surrounding container and said axially collapsible inner contrainer is evacuated.

6. A pressurized fluid dispenser as in claim 1 wherein the pistonlike member comprises a substantially flat, form fitting element that conforms closely to the inner wall of said outer surrounding, a bellows element integral with said substantially flat form fitting element which forms the edge thereof, said bellows element being hermetically attached to the bottom edge of said outer surrounding container, whereby said pistonlike element is sealably attached to the outer surrounding container so that it can act to expel the contents of said inner axially collapsible container, when said space between inner axially collapsible container and said outer surrounding container is evacuated.

7. In a pressurized fluid dispenser such as described in claim 1 wherein said evacuation means comprising a tubulated opening in the wall of said outer surrounding container through which air can be evacuated from said space between said inner axially collapsible container and said outer surrounding container, and plug means for closing said tubulation after the air in said space between said inner axially collapsible container and said outer surrounding container is substantially removed.

8. A pressurized fluid dispenser as in claim 1 wherein the outer surrounding container is a bellows container having side walls formed of bellows elements and a bottom wall wherein said piston means is comprised of the bottom wall of said bellows container which upon collapse of said side wall bellows elements presses against said inner container to expel its contents when the valve means is open.

9. A pressurized fluid dispenser as in claim 1 wherein the pressure on the contents of the inner axially collapsible inner container can be determined by the ratio of the projected area of the axially collapsible inner container perpendicular to the axis of said inner axially collapsible inner container, to the projected area of said pistonlike member perpendicular to the axis of said inner axially collapsible inner container.

10. A pressurized fluid dispenser as in claim 1 wherein said valve means for controlling the egress of the fluid from the inner axially collapsible container is one of the standard valves used in aerosol dispensing containers.

11. A pressurized fluid dispenser as in claim 1 utilizing a standard valve as used in aerosol dispensers wherein the means for securing said valve to said pressurized dispenser utilizes crimping of said valve to the neck regions of said inner and outer containers where they are in intimate and parallel contact to prevent leakage of either contents or air.

12. A pressurized fluid dispenser as in claim 1 wherein said dispenser is plastic.

13. A pressurized dispenser such as in claim 1 also including a tubulation for evacuating said space between said inner axially collapsible container and said outer surrounding container, and including means for closing said tubulation.

14. A pressurized dispenser such as in claim 13 wherein said tubulation is in sid piston means in the region between the outer rim and the contact area between said inner axially collapsible container and said piston means.

15. A pressurized dispenser as in claim 13 wherein said means for closing said tubulation is a cap element secured to and hermetically sealing the opening of said tubulation.

16. A pressurized dispenser as in claim 14 wherein said means for closing said tubulation is a cap element secured to and hermetically sealing the opening of said tubulation.

17. A pressurized dispenser such as in claim 14 wherein said tubulation includes an annular lip outwardly extending around the opening of said tubulation and wherein said means for closing said tubulation is crimping the annular lip together to hermetically seal the opening of said tubulation.

18. A pressurized dispenser such as in claim 13 wherein said tubulation includes an annular lip outwardly extending around the opening of said tubulation and wherein said means for closing said tubulation is crimping the annular lip together to hermetically seal the opening of said tubulation.

19. A pressurized fluid dispenser as in claim 1 wherein said dispenser is metal.

20. A pressurized fluid dispenser comprising:

(a) an inner collapsible container gravity fillable with a dispensible medium;
(b) valve means operatively connected to said inner container for selectively releasing said dispensible medium from said inner container;
(c) an outer surrounding container;
(d) a chamber defined at least in part by said inner and outer containers, said chamber capable of being evacuated;
(e) means for evacuating said chamber; and
(f) piston means acting on said inner container to collapse said container and provide pressure for ejecting said dispensible medium when said valve means is open, said piston means having a first side thereof exposed to the atmosphere, a second side thereof having a portion exposed to the evacuatable chamber and a portion bearing against said inner container, the area of said first side being sufficiently larger than the area of said second side exposed to the evacuated chamber so that the pressure differential of the atmosphere on one side of the piston means and the evacuated chamber and inner container on the other side of the piston means will permit the piston means to force the dispensible medium from the inner container when the valve means is opened.

* * * * *

UNITED STATES PATENT AND TRADEMARK OFFICE

CERTIFICATE OF CORRECTION

PATENT NO. : 4,147,282

DATED : April 3, 1979

INVENTOR(S) : Sidney Levy

It is certified that error appears in the above-identified patent and that said Letters Patent are hereby corrected as shown below:

Claim 4, line 8, delete "pistonlike member" and substitute --piston means--;

Claim 5, line 5, delete "pistonlike member" and substitute --piston means--, line 9, delete "pistonlike element" and substitute --piston means--, lines 10 and 11, delete "pistonlike member" and substitute --piston means--, line 12, delete "contrainer" and substitute --container--;

Claim 6, line 2, delete "pistonlike member" and substitute --piston means--, line 8, delete "pistonlike" and substitute --piston means--, line 9, delete "element";

Claim 9, line 7, delete "pistonlike member" and substitute --piston means--.

UNITED STATES PATENT AND TRADEMARK OFFICE

CERTIFICATE OF CORRECTION

PATENT NO. 4,147,282

DATED April 3, 1979

INVENTOR(S) Sidney Levy

It is certified that error appears in the above-identified patent and that said Letters Patent are hereby corrected as shown below:

Claim 3, line 2, delete "member";

Claim 4, line 2, delete "member", line 11, delete "if" and substitute --it--;

Claim 5, line 2, delete "member", line 7, delete "member";

Claim 14, line 2, delete "sid" and substitute --said--.

Signed and Sealed this

*Eighth* Day of *January 1980*

[SEAL]

*Attest:*

SIDNEY A. DIAMOND

*Attesting Officer*

*Commissioner of Patents and Trademarks*